US010269248B2

(12) United States Patent
Yatsuda et al.

(10) Patent No.: US 10,269,248 B2
(45) Date of Patent: Apr. 23, 2019

(54) INFORMATION PROCESSING APPARATUS AND NON-TRANSITORY COMPUTER READABLE RECORDING MEDIUM

(71) Applicant: FUJI XEROX CO., LTD., Tokyo (JP)

(72) Inventors: Kazutoshi Yatsuda, Kanagawa (JP); Masayasu Takano, Kanagawa (JP); Kaoru Yasukawa, Kanagawa (JP); Takaaki Kashiwagi, Kanagawa (JP); Ryosuke Nakanishi, Kanagawa (JP); Daigo Kusano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 207 days.

(21) Appl. No.: 15/345,728

(22) Filed: Nov. 8, 2016

(65) Prior Publication Data

US 2017/0301240 A1 Oct. 19, 2017

(30) Foreign Application Priority Data

Apr. 14, 2016 (JP) ..... 2016-080849

(51) Int. Cl.
*G08G 1/16* (2006.01)
*G08C 17/02* (2006.01)

(52) U.S. Cl.
CPC ..... *G08G 1/166* (2013.01); *G08C 17/02* (2013.01); *G08G 1/162* (2013.01)

(58) Field of Classification Search
CPC ..... G08G 1/166; G08G 1/162; G08C 17/02
USPC ..... 701/2
See application file for complete search history.

(56) References Cited

U.S. PATENT DOCUMENTS 8,554,403 B2 10/2013 Tsuchikiri et al.
9,043,079 B2 5/2015 Tsuchikiri et al.
2017/0116861 A1* 4/2017 Ichihara ..... G08G 1/0112

FOREIGN PATENT DOCUMENTS

JP 4414470 B1 2/2010
JP 4928532 B2 5/2012

* cited by examiner

*Primary Examiner* — Brian P Sweeney
(74) *Attorney, Agent, or Firm* — Oliff PLC

(57) ABSTRACT

An information processing apparatus, including a collection unit that collects position data representing a position of a moving body and operating data representing an operating state of the moving body, during a movement of the moving body, a range setting unit that sets a range in which the moving body is likely to cause a collision, based on a movement distance and direction required until a braking of the moving body, when a control of the moving body is difficult, an extraction unit that extracts a moving body existing within the range or a moving body which is likely to enter into the range, and a transmitting unit that transmits information representing possibility of being collided, to the moving body extracted by the extraction unit.

8 Claims, 10 Drawing Sheets

INFORMATION PROCESSING APPARATUS AND NON-TRANSITORY COMPUTER READABLE RECORDING MEDIUM

CROSS-REFERENCE TO RELATED APPLICATIONS

This application is based on and claims priority under 35 USC 119 from Japanese Patent Application No. 2016-080849 filed Apr. 14, 2016.

BACKGROUND

Technical Field

The present invention relates to an information processing apparatus and a non-transitory computer readable recording medium.

SUMMARY

According to an aspect of the invention, there is provided an information processing apparatus, including:

a collection unit that collects position data representing a position of a moving body and operating data representing an operating state of the moving body, during a movement of the moving body;

a range setting unit that sets a range in which the moving body is likely to cause a collision, based on a movement distance and direction required until a braking of the moving body, when a control of the moving body is difficult;

an extraction unit that extracts a moving body existing within the range or a moving body which is likely to enter into the range; and a transmitting unit that transmits information representing possibility of being collided, to the moving body extracted by the extraction unit.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the accompanying drawings.

Figure 1:
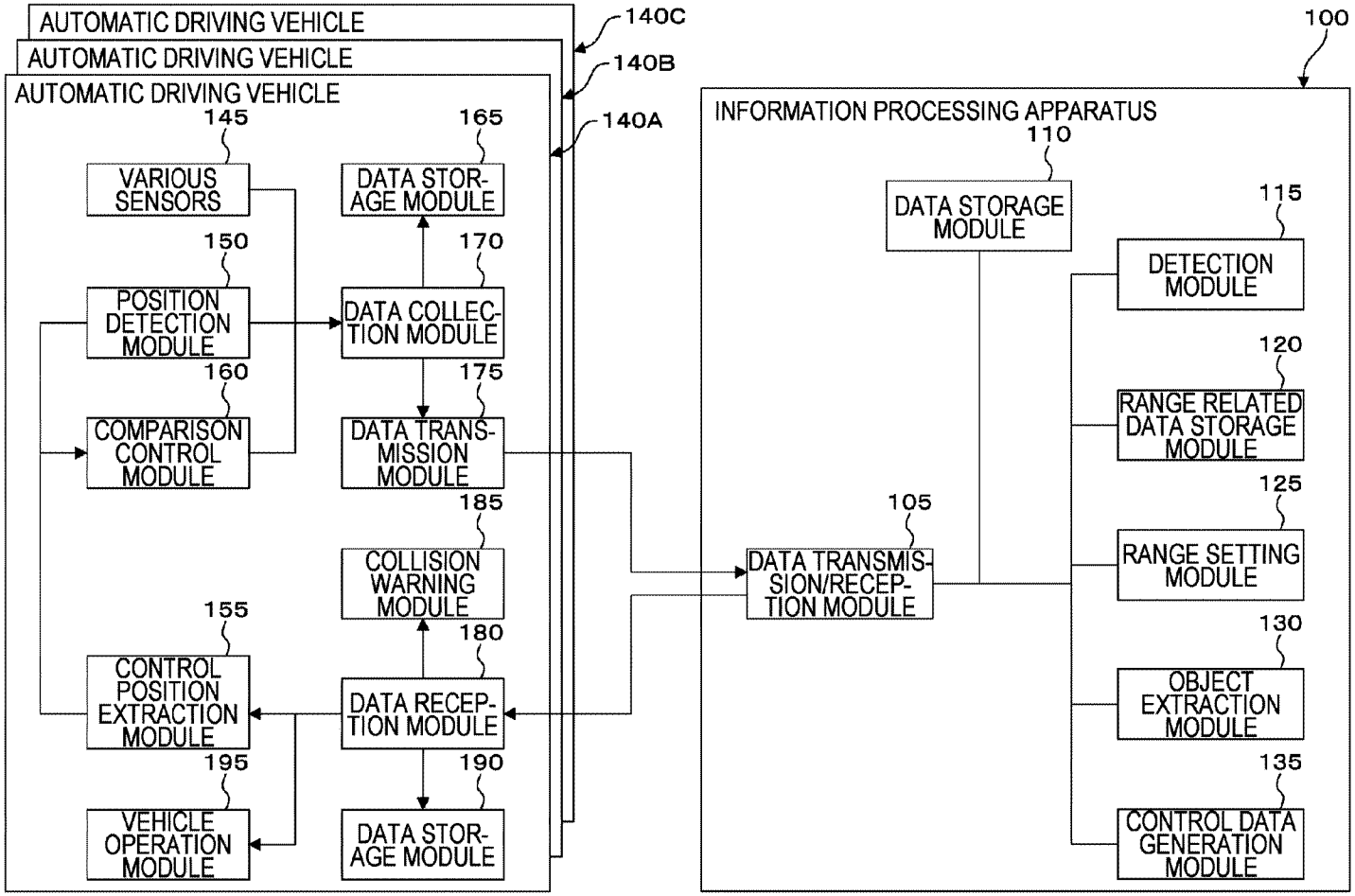
FIG. 1 is a conceptual module configuration view relating to an exemplary configuration of an exemplary embodiment.

FIG. 1 illustrates a conceptual module configuration view of an exemplary configuration of an exemplary embodiment.

A module, in general, indicates a logically separable component such as software (a computer program) or hardware. Accordingly, a module in the present exemplary embodiment indicates not only a module in a computer program but also a module in a hardware configuration. Hence, descriptions of the present exemplary embodiments also include descriptions of a computer program to function as the module (a program to cause a computer to execute each process, a program to cause a computer to function as each unit, and a program to cause a computer to implement each function), a system, and a method. Here, for convenience of descriptions, the expressions "store," "cause to store," and equivalent expressions thereto will be used, and when an exemplary embodiment is a computer program, the expressions indicate causing data or the like to be stored in a storage device or performing a control to store data or the like in a storage device. In addition, one module may correspond to one function. In implementation, however, one module may be configured as one program, plural modules may be configured as one program, and in reverse, one module may be configured as plural programs. In addition, plural modules may be executed by one computer, or one module may be executed by plural computers in a distributed or parallel environment. In addition, one module may include another module. In addition, hereinafter, the term "connection" is also used in a case of a logical connection (e.g., data exchange, instructions, and a reference relationship among data), in addition to a physical connection. The term "predetermined" refers to being determined prior to a target processing, and includes the meaning of being determined according to a circumstance/state at or until a specific time point before a processing by the present exemplary embodiment is started, or prior to a target processing even after a processing by the present exemplary embodiment is started. When plural "predetermined values" exist, the values may be different from each other, or two or more of the values (including any values, of course) may be identical to each other. A description indicating that "when it is A, B is performed" is used to indicate that "whether it is A is determined, and when it is determined that it is A, B is performed," except for a case where the determination of whether it is A is unnecessary.

In addition, a system or an apparatus includes a case where the system or the apparatus is implemented by, for example, one computer, one hardware component, and one device, in addition to a case where plural computers, hardware components, devices and others are configured to be connected to each other by a communication unit such as a network (including one-to-one corresponding communication connection). The terms "apparatus" and "system" are used to have the same meaning. Of course, the "system" does not include a system merely meaning a social "structure" (social system) which is an artificial engagement.

In addition, target information is read from a storage device per processing by each module or for each of plural processes which is executed in a module. After the processing is executed, the processing result is recorded in the storage device. Accordingly, descriptions of the reading from the storage device prior to the processing and the recording in the storage device after the processing may be omitted. In addition, the storage device may include, for example, a hard disk, a random access memory (RAM), an external storage medium, a storage device through a communication line, and a resistor within a central processing unit (CPU).

An information processing apparatus 100 of the present exemplary embodiment collects operating data from an automatic driving vehicle 140 which is an example of a moving body, and controls another automatic driving vehicle 140. As illustrated in the example of FIG. 1, the information processing apparatus 100 includes a data transmission/reception module 105, a data storage module 110, a detection module 115, a range related data storage module 120, a range setting module 125, an object extraction module 130, and a control data generation module 135.

Here, the "moving body" may be a vehicle used for a movement of a human being or an object and includes, for example, an automobile, a two-wheeled vehicle, a trolley, ship, a plane, a helicopter, a drone, and a wheel chair. The moving body may be able to communicate with the information processing apparatus 100. Hereinafter, an automobile (an automatic driving vehicle 140) will be described as a main example of the moving body. The automobile includes, for example, an automatic driving car and an automobile called, for example, a connected car.

The automatic driving car may receive vehicle control data for an operation of the vehicle itself, in addition to a function to collect and transmit operating data of the vehicle, and operate the vehicle by using the vehicle control data. Specifically, the operating data collected and transmitted by the vehicle are interpreted, and vehicle control data for automatic driving (e.g., a traveling direction, a vehicle speed, and a steering angle) are generated. The generated vehicle control data are received, and the operation of the automatic driving car is controlled.

In order to improve the safety of an automobile (without being limited to the connected car or the automatic driving car), an operation support system such as a collision damage reduction brake or an active cruise control (ACC), or a cooperative operation support system implemented by a vehicle-to-vehicle (V2V) communication such as a cooperative active cruise control (CACC) has been developed. These related operation support systems for improving the safety of automobiles suppose that an own vehicle (a target automobile) causes actions to avoid a collision or reduce a damage.

In a circumstance where a control of an automobile is difficult, controlling the automobile itself may not be performed. Thus, it is required to notify other automobiles existing around the uncontrollable automobile of possibility of being collided. Thus, the information processing apparatus 100 anticipates the possibility that an automatic driving vehicle 140 may collide with another automatic driving vehicle 140, for example, by using operating data acquired from the automatic driving vehicle 140, and performs a control to the another automatic driving vehicle 140 to avoid an accident (including notification of a possible collision).

The detection module 115 of the information processing apparatus 100 acquires first position data of a first moving body and second position data of a second moving body. Then, the range setting module 125 specifies a range in which the first moving body may cause a collision, based on the first position data and the operating data. Subsequently, the control data generation module 135 determines whether the second moving body exists in the range, based on the second position data, and makes a control instruction to the second moving body to cause the second moving body to move out of the range when it is determined that the second moving body exists in the range.

In addition, the range related data storage module 120 stores braking data. The range setting module 125 may calculate a reference movement distance required until the braking is implemented under the same condition as a braking condition included in the braking data within the range related data storage module 120. Then, the above-described range may be specified by using the calculated reference movement distance. In addition, the braking data may be prepared based on the operating data.

The data transmission/reception module 105 is connected to the data storage module 110, the detection module 115, the range related data storage module 120, the range setting module 125, the object extraction module 130, and the control data generation module 135, and further connected to a data transmission module 175 and a data reception module 180 of an automatic driving vehicle 140 through communication lines. The data transmission/reception module 105 performs a communication with plural automatic driving vehicles 140. Here, the communication may be a wireless communication.

The data storage module 110 is connected to the data transmission/reception module 105. The data storage module 110 stores the operating data of the automatic driving vehicle 140 as received by the data transmission/reception module 105. In addition, the operating data may be stored by layers. Specifically, layer-based condition data for the storage by layers are also stored, and the operating data received by the data transmission/reception module 105 are applied to the layer-based condition data so that the operating data are stored by layers. Here, each layer may be each vehicle model or each vehicle.

"During the movement of an automatic driving vehicle 140" indicates a time period during which the automatic driving vehicle 140 is moving (during the traveling of the automatic driving vehicle 140). The automatic driving vehicle 140 does not need to move during all the time period, and the time period may include a temporary stop. The temporary stop may be, for example, a stop instructed by a traffic signal (the so-called red light).

Figure 3:
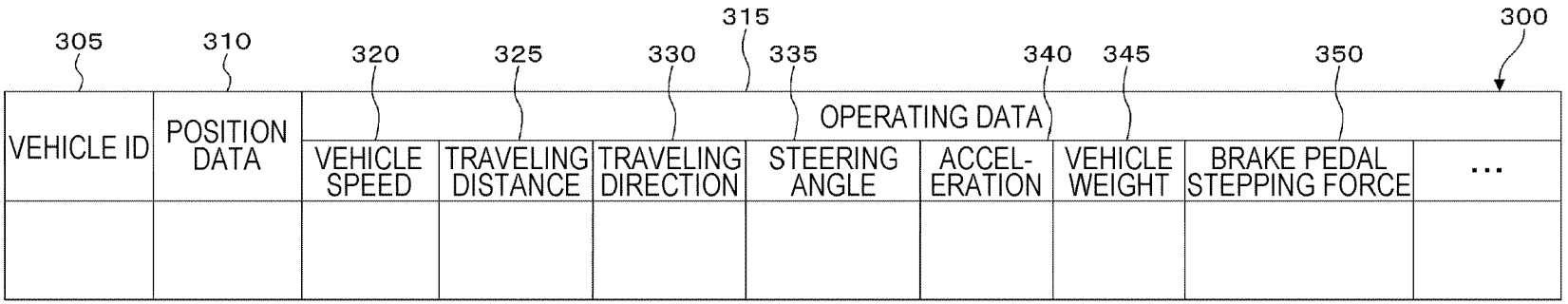
FIG. 3 is a view for explaining an exemplary data structure of an interpretation target data table.

The operating data stored by the data storage module 110 may be, for example, an interpretation target data table 300. FIG. 3 is a view for explaining an exemplary data structure of the interpretation target data table 300. The interpretation target data table 300 includes a vehicle ID field 305, a position data field 310, and an operating data field 315. The operating data field 315 includes, for example, a vehicle speed field 320, a traveling distance field 325, a traveling direction field 330, a steering angle field 335, an acceleration field 340, a vehicle weight field 345, and a brake pedal stepping force field 350. In the present exemplary embodiment, the vehicle ID field 305 stores information for uniquely identifying a vehicle (vehicle identification (ID) which is also called a vehicle identification number (VID)). The position data field 310 stores position data of the vehicle (e.g., the latitude and the longitude). The operating data field 315 stores operating data. The vehicle speed field 320 stores a speed of the vehicle (vehicle speed). The traveling distance field 325 stores a traveling distance of the vehicle. The traveling direction field 330 stores a traveling direction of the vehicle. The steering angle field 335 stores a steering angle of the vehicle. The acceleration field 340 stores an acceleration of the vehicle. The vehicle weight field 345 stores a weight of the vehicle. The brake pedal stepping force field 350 stores a brake pedal stepping force of the vehicle.

Figure 4:
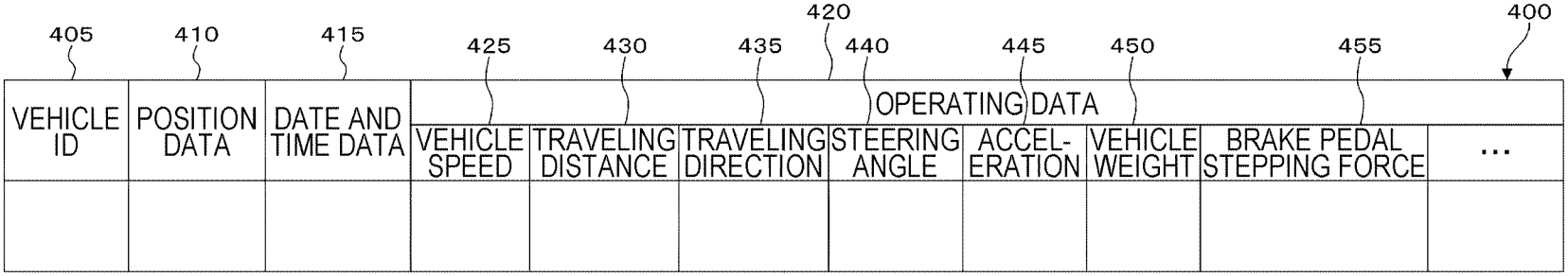
FIG. 4 is a view for explaining an exemplary data structure of an interpretation target data table.

In addition, the operating data stored by the data storage module 110 may be, for example, an interpretation target data table 400. FIG. 4 is a view for explaining an exemplary data structure of the interpretation target data table 400. The interpretation target data table 400 is prepared by adding a date and time data field 415 to the interpretation target data table 300 illustrated in the example of FIG. 3. The interpretation target data table 400 includes a vehicle ID field 405, a position data field 410, a date and time data field 415, and an operating data field 420. The operating data field 420 includes a vehicle speed field 425, a traveling distance field 430, a traveling direction field 435, a steering angle field 440, an acceleration field 445, a vehicle weight field 450, and a brake pedal stepping force field 455. The vehicle ID field 405 stores vehicle ID. The position data field 410 stores position data representing a position of the vehicle at the acquisition time of operating data. The date and time data field 415 stores a date and time when the operating data of the vehicle are acquired (which may be a year, a month, a day, an hour, a minute, a second, a fraction of a second, or combinations thereof). The operating data field 420 stores operating data. The vehicle speed field 425 stores a speed of the vehicle (vehicle speed) at a specific time point. The traveling distance field 430 stores a traveling distance of the vehicle at a specific time point. The traveling direction field 435 stores a traveling direction of the vehicle at a specific time point. The steering angle field 440 stores a steering angle of the vehicle at a specific time point. The acceleration field 445 stores an acceleration of the vehicle at a specific time point. The vehicle weight field 450 stores a weight of the vehicle at a specific time point (which may include vehicle passengers). The brake pedal stepping force field 455 stores a brake pedal stepping force at a specific time point.

Figure 5:
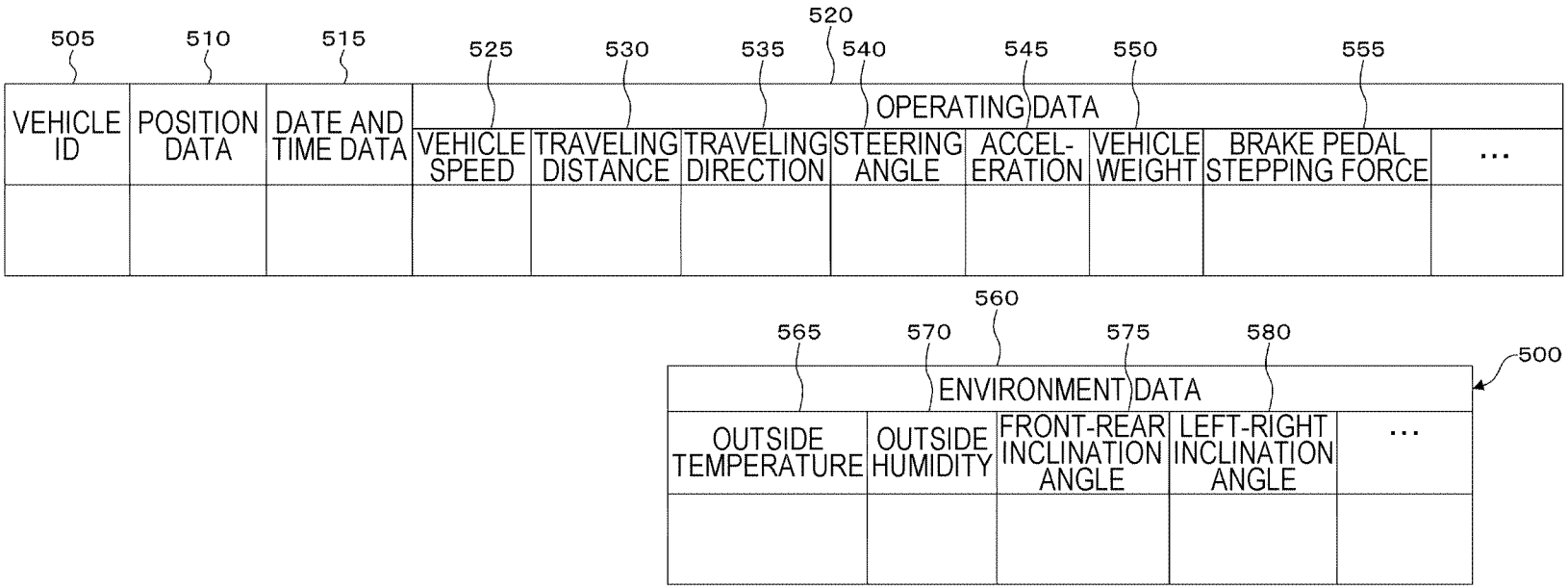
FIG. 5 is a view for explaining an exemplary data structure of an interpretation target data table.

In addition, the operating data stored by the data storage module 110 may be, for example, an interpretation target data table 500. FIG. 5 is a view for explaining an exemplary data structure of the interpretation target data table 500. The interpretation target data table 500 is prepared by adding an environment data field 555 to the interpretation target data table 400 illustrated in the example of FIG. 4. The interpretation target data table 500 includes a vehicle ID field 505, a position data field 510, a date and time data field 515, an operating data field 520, and a brake pedal stepping force field 555. The operating data field 520 includes a vehicle speed field 525, a traveling distance field 530, a traveling direction field 535, a steering angle field 540, an acceleration field 545, a vehicle weight field 550, and an environment data field 555. The environment data field 560 includes an outside temperature field 565, an outside humidity field 570, a front-rear inclination angle field 575, and a left-right inclination angle field 580. The environment data field 560 stores environment data. The outside temperature field 565 stores an outside temperature at a specific time point (position). The outside humidity field 570 stores an outside humidity at a specific time point (position). The front-rear inclination angle field 575 stores a front-rear inclination angle of the vehicle at a specific time point. The left-right inclination angle field 580 stores a left-right inclination angle of the vehicle at a specific time point.

Additionally, a vehicle model of the vehicle, headlight ON/OFF, a vehicle direction and others may be stored.

The detection module 115 is connected to the data transmission/reception module 105. The detection module 115 collects the position data representing a position of the automatic driving vehicle 140 and the operating data representing an operating state of the automatic driving vehicle 140 during the movement of the automatic driving vehicle 140, through the data transmission/reception module 105. Alternatively, the data may be read from the data storage module 110.

Then, the detection module 115 detects whether the automatic driving vehicle 140 is in a circumstance where the control thereof is difficult.

For example, when a difference between a position of the automatic driving vehicle 140 and a normally controlled position thereof is equal to or larger than a predetermined threshold value, the detection module 115 may detect that the automatic driving vehicle 140 is in the circumstance where the control thereof is difficult. For example, when the automatic driving vehicle 140 slips (e.g., the hydroplaning phenomenon in rainfall or snow accumulation), this case corresponds to the "circumstance where the control thereof is difficult." Additionally, the "circumstance where the control thereof is difficult" includes, for example, a case where the brake is failed (e.g., the vapor lock phenomenon occurs due to the overheating of a brake). Specifically, an expected position of the automatic driving vehicle 140 after $\Delta t$ from a control instruction for the braking by a brake or the like (after a predetermined time) is compared with the position data of the automatic driving vehicle 140 as collected after $\Delta t$, and it is determined whether a difference exceeding a predetermined threshold value exists. Here, the threshold value may be determined for, for example, each vehicle model or each vehicle.

In addition, for example, when it is detected that a component for the movement of the automatic driving vehicle 140 is failed, the detection module 115 may detect that the automatic driving vehicle 140 is in the circumstance where the control thereof is difficult. For example, a failure of the brake or the engine is included.

The range related data storage module 120 is connected to the data transmission/reception module 105. The range related data storage module 120 stores data necessary to set a range (area) in which the automatic driving vehicle 140 may cause a collision, in a circumstance where the control of the automatic driving vehicle 140 is difficult. That is, the data are necessary to calculate a movement distance required until the braking of the automatic driving vehicle 140.

For example, the range related data storage module 120 stores a braking condition and a braking distance under the braking condition (a traveling distance until the vehicle is stopped). Specifically, the braking condition may be, for example, a vehicle speed, a vehicle weight, and a brake pedal stepping force. A braking distance actually measured under the braking condition may be stored in advance in association with the braking condition, or the braking distance may be calculated by using an equation adopting the braking condition as a variable.

The range setting module 125 is connected to the data transmission/reception module 105. When the detection module 115 detects that a target automatic driving vehicle 140 is in the circumstance where the control thereof is difficult, the range setting module 125 sets a range in which the automatic driving vehicle 140 may cause a collision, from a movement distance and direction necessary until the braking of the automatic driving vehicle 140.

The movement distance necessary until the braking of the automatic driving vehicle 140 may be calculated by using the data for determining the braking distance (e.g., the above-described vehicle speed, vehicle weight, and brake pedal stepping force acquired from the automatic driving vehicle 140) and the data within the range related data storage module 120.

In addition, the direction may be determined by, for example, a steering angle of the automatic driving vehicle 140.

In addition, since the calculated braking distance corresponds to a braking distance for a case where a moving body is not in the circumstance where the control thereof is difficult (in a normal case), a braking distance in the circumstance where the control of the automatic driving vehicle 140 is difficult may be calculated by adding a predetermined distance to the braking distance or multiplying the braking distance by a predetermined value, so that the braking distance becomes larger than the braking distance in the normal case.

Also, a direction in the circumstance where the control of the automatic driving vehicle 140 is difficult may be calculated by adding a predetermined steering width (angle) to the steering angle at the time point of the circumstance or multiplying the steering angle by a predetermined value (two values for positive and negative directions as an angle). The predetermined value or the like has been determined by performing a statistical process using results obtained from previously conducted experiments and others.

Furthermore, the possible collision range may be set by using environment data (e.g., an outside temperature, an outside humidity, a front-rear inclination angle, and a left-right inclination angle). The environment data may be the data detected by various sensors 145 within the automatic driving vehicle 140, or rainfall/snowfall information and others may be acquired from a server handling weather information through the Internet or the like. For example, the accuracy of the possible collision range may be increased by estimating the road surface state from, for example, rainfall/snow accumulation and descending/ascending roads.

As described above, in the circumstance where the control of the automatic driving vehicle 140 is difficult, the range determined from the movement distance and direction until the automatic driving vehicle 140 is stopped is set as the range in which the automatic driving vehicle 140 may cause a collision.

The object extraction module 130 is connected to the data transmission/reception module 105. The object extraction module 130 extracts an automatic driving vehicle 140 existing within the range set by the range setting module 125 or an automatic driving vehicle 140 which may enter into the range. Specifically, information on a preceding vehicle, an oncoming vehicle and others are extracted.

The information processing apparatus 100 communicates with plural automatic driving vehicles 140 and collects position data thereof. Hence, the information processing apparatus 100 may extract an automatic driving vehicle 140 existing within the range set by the range setting module 125 by using the position data. In addition, the information processing apparatus 100 communicates with plural automatic driving vehicles 140 and collects position data, speeds, steering angles thereof and so on. Hence, the information processing apparatus 100 may extract an automatic driving vehicle 140 which may enter into the range set by the range setting module 125, by using the data.

The control data generation module 135 is connected to the data transmission/reception module 105. The control data generation module 135 transmits information representing possibility of being collided, to the automatic driving vehicle 140 extracted by the object extraction module 130. The information is, for example, warning information, and the automatic driving vehicle 140 receiving the warning information may present the warning on a display or output, for example, a warning voice from a speaker.

In addition, the control data generation module 135 may generate control data to cause the automatic driving vehicle 140 extracted by the object extraction module 130 to move out of the range set by the range setting module 125. Then, the control data generation module 135 may transmit the generated control data to the automatic driving vehicle 140 extracted by the object extraction module 130 through the data transmission/reception module 105. That is, the vehicle control data are generated and transmitted to an automatic driving vehicle 140 which may be collided (an automatic driving vehicle 140 other than the automatic driving vehicle 140 in the circumstance where the control thereof is difficult) so as to cause the automatic driving vehicle 140 to move out of the range, thereby avoiding the collision. The control data are generated in accordance with position data, a speed, a steering angle and so on of the automatic driving vehicle 140 of the transmission destination. For example, a brake operation or the like may be performed not to cause the vehicle to enter into the possible collision range. Of course, in order to control the automatic driving vehicle 140 of the transmission destination, vehicle control data suitable for the vehicle model or the like may be generated.

The automatic driving vehicle 140 includes various sensors 145, a position detection module 150, a control position extraction module 155, a comparison control module 160, a data storage module 165, a data collection module 170, a data transmission module 175, a data reception module 180, a collision warning module 185, a data storage module 190, and a vehicle operation module 195.

The various sensors 145 are connected to the data collection module 170. The various sensors 145 detect an operating state of the automatic driving vehicle 140. The various sensors 145 detect, for example, a traveling direction, an outside humidity, a front-rear inclination angle, an outside temperature, a left-right inclination angle, a vehicle speed, and a traveling distance.

In addition, the various sensors 145 may include a sensor that detects a failure of components within the automatic driving vehicle 140, especially, components for the movement of the automatic driving vehicle 140 (e.g., the brake and the engine).

The position detection module 150 is connected to the comparison control module 160 and the data collection module 170. The position detection module 150 acquires position data (e.g., the latitude and the longitude) of the automatic driving vehicle 140. For example, a global positioning system (GPS) or a beacon may be used.

The control position extraction module 155 is connected to the comparison control module 160 and the data reception module 180. The control position extraction module 155 extracts position data within the control data received by the data reception module 180.

The comparison control module 160 is connected to the position detection module 150, the control position extraction module 155, and the data collection module 170. The comparison control module 160 compares the position data detected by the position detection module 150 and the position data extracted by the control position extraction module 155 with each other. That is, it is determined whether a collision could be avoided.

The data storage module 165 is connected to the data collection module 170. The data storage module 165 stores the position data, the operating data and others collected by the data collection module 170 from the various sensors 145 and the position detection module 150. For example, the above-described interpretation target data tables 300, 400, and 500 and others are stored.

The data collection module 170 is connected to the various sensors 145, the position detection module 150, the comparison control module 160, the data storage module 165, and the data transmission module 175. The data collection module 170 stores the position data, the operating data and others collected from the various sensors 145 and the position detection module 150, in the data storage module 165, and transmits the data to the information processing apparatus 100 through the data transmission module 175.

The data transmission module 175 is connected to the data collection module 170, and further connected to the data transmission/reception module 105 of the information processing apparatus 100 through a communication line. The data transmission module 175 transmits the data collected by the data collection module 170, to the information processing apparatus 100.

The data reception module 180 is connected to the control position extraction module 155, the collision warning module 185, the data storage module 190, and the vehicle operation module 195, and further connected to the data transmission/reception module 105 of the information processing apparatus 100 through a communication line. The data reception module 180 receives the warning information (information representing possibility of being collided) or the control data transmitted by the information processing apparatus 100.

The collision warning module 185 is connected to the data reception module 180. Upon receiving the warning information, the collision warning module 185 presents the warning on a display or outputs, for example, a warning voice from a speaker.

The data storage module 190 is connected to the data reception module 180. The data storage module 190 stores the control data received by the data reception module 180.

The vehicle operation module 195 is connected to the data reception module 180. The vehicle operation module 195 controls the vehicle according to the control data received by the data reception module 180. For example, a brake operation is conducted according to the control data. As a result, the vehicle is controlled not to enter into the possible collision range so that the collision is avoided.

Figure 2:
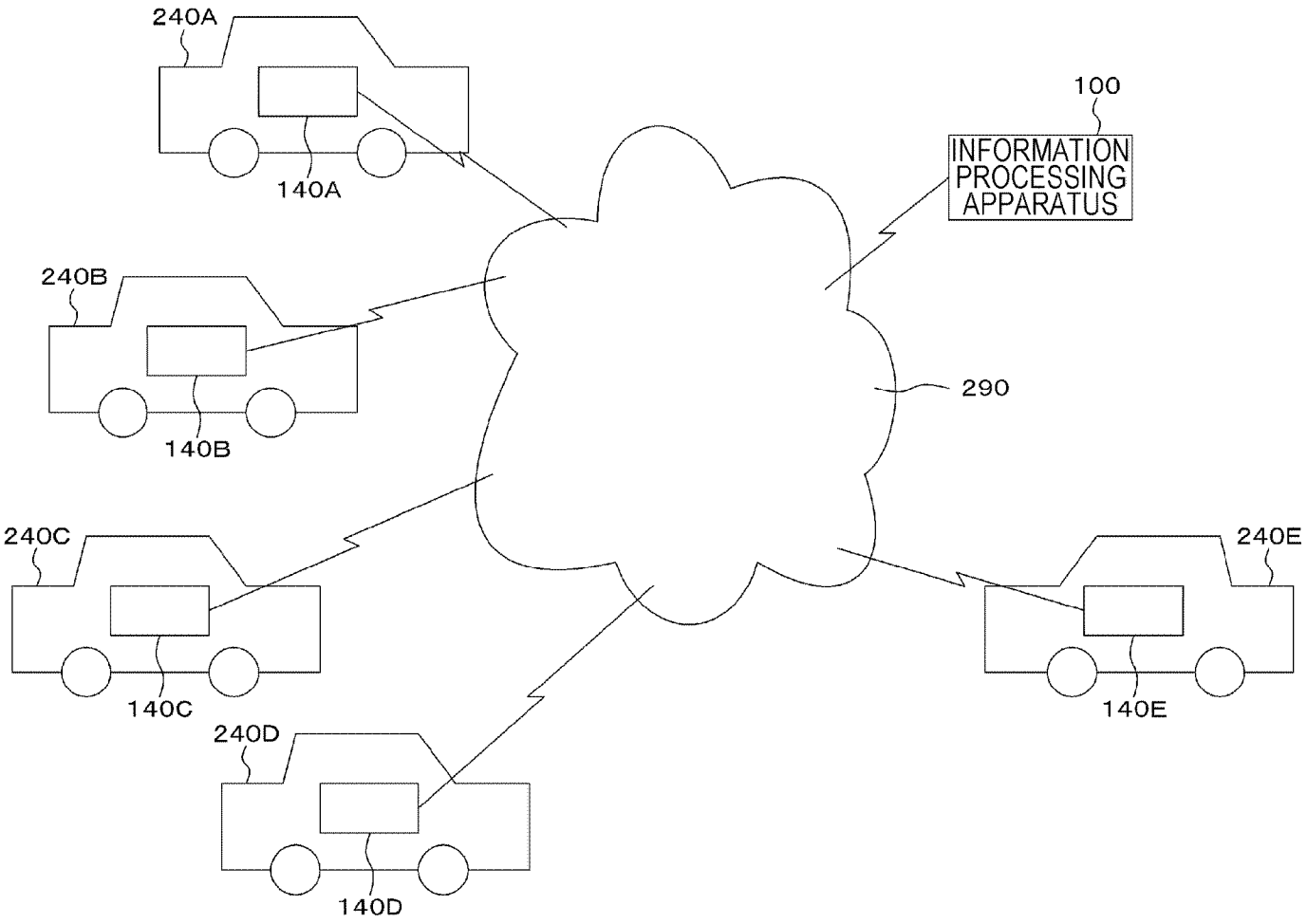
FIG. 2 is a view for explaining an exemplary system configuration using an exemplary embodiment.

FIG. 2 is a view for explaining an exemplary system configuration using the present exemplary embodiment.

For example, a vehicle 240A includes an automatic driving vehicle 140A and the like.

The information processing apparatus 100, the automatic driving vehicle 140A, an automatic driving vehicle 140B, an automatic driving vehicle 140C, an automatic driving vehicle 140D, and an automatic driving vehicle 140E are connected with each other through a communication line 290. The communication with an automatic driving vehicle 140 is a wireless communication. However, the communication line 290 may be a wireless communication, a wired communication, or a combination thereof, and for example, the Internet as a communication infrastructure. In addition, the function by the information processing apparatus 100 may be implemented as a cloud service.

Figure 6:
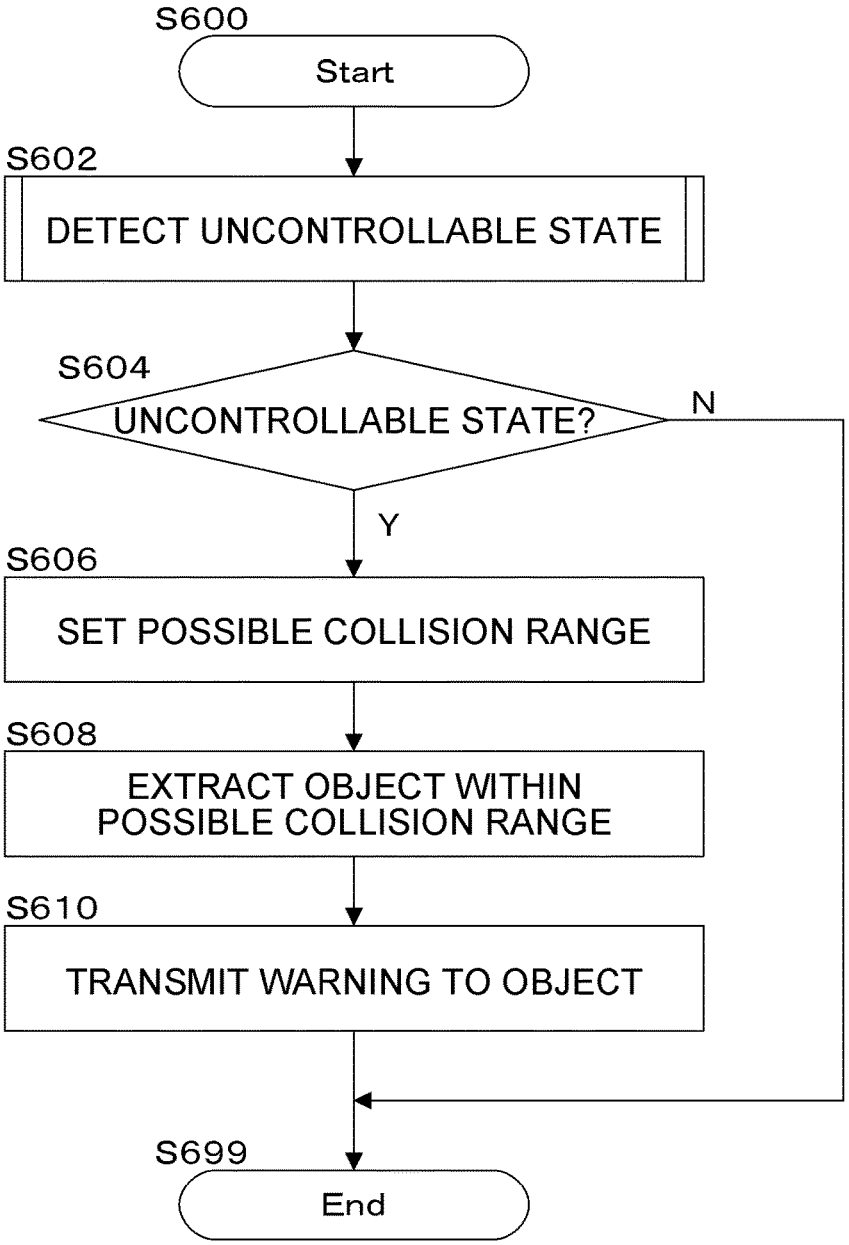
FIG. 6 is a flow chart illustrating an exemplary processing by an exemplary embodiment.

FIG. 6 is a flow chart illustrating an exemplary processing by the present exemplary embodiment (the information processing apparatus 100).

In a step S602, the detection module 115 detects whether each automatic driving vehicle 140 is in an uncontrollable state. Specific processes will be described later by using the flow chart illustrated in the example of FIG. 8 or FIG. 9.

In a step S604, the detection module 115 determines whether an automatic driving vehicle 140 under an uncontrollable state exists. When it is determined that an automatic driving vehicle 140 under an uncontrollable state exists, the process proceeds to a step S606, and otherwise, the process is ended (S699).

In the step S606, the range setting module 125 sets the possible collision range.

In a step S608, the object extraction module 130 extracts an object existing within the possible collision range (an automatic driving vehicle 140 which may be collided).

In a step S610, the control data generation module 135 transmits a warning to the object.

Figure 7:
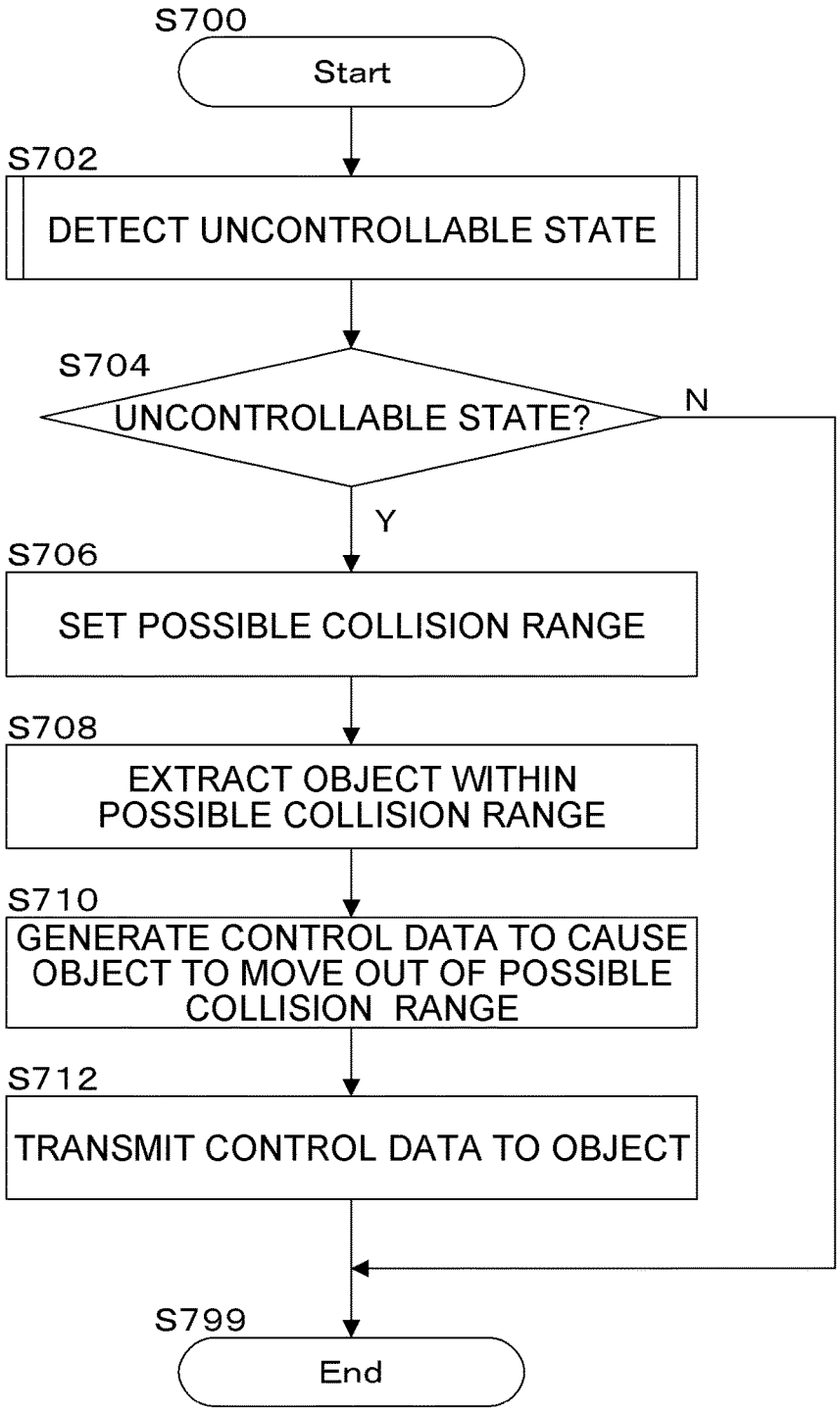
FIG. 7 is a flow chart illustrating an exemplary processing by an exemplary embodiment.

FIG. 7 is a flow chart illustrating an exemplary processing by the present exemplary embodiment (the information processing apparatus 100). Different processes from those of the flow chart illustrated in FIG. 6 are performed (a process of generating control data to cause the object to move out of the possible collision range).

In a step S702, the detection module 115 detects whether each automatic driving vehicle 140 is under the uncontrollable state. Specific processes will be described later by using the flow chart illustrated in the example of FIG. 8 or FIG. 9.

In a step S704, the detection module 115 determines whether an automatic driving vehicle 140 under an uncontrollable state exists. When it is determined that an automatic driving vehicle 140 under an uncontrollable state exists, the process proceeds to a step S706, and otherwise, the process is ended (S799).

In the step S706, the range setting module 125 sets the possible collision range.

In a step S708, the object extraction module 130 extracts an object existing within the possible collision range (an automatic driving vehicle 140 which may be collided).

In a step S710, the control data generation module 135 generates control data to cause the object to move out of the possible collision range.

In a step S712, the control data generation module 135 transmits the control data to the object.

Figure 8:
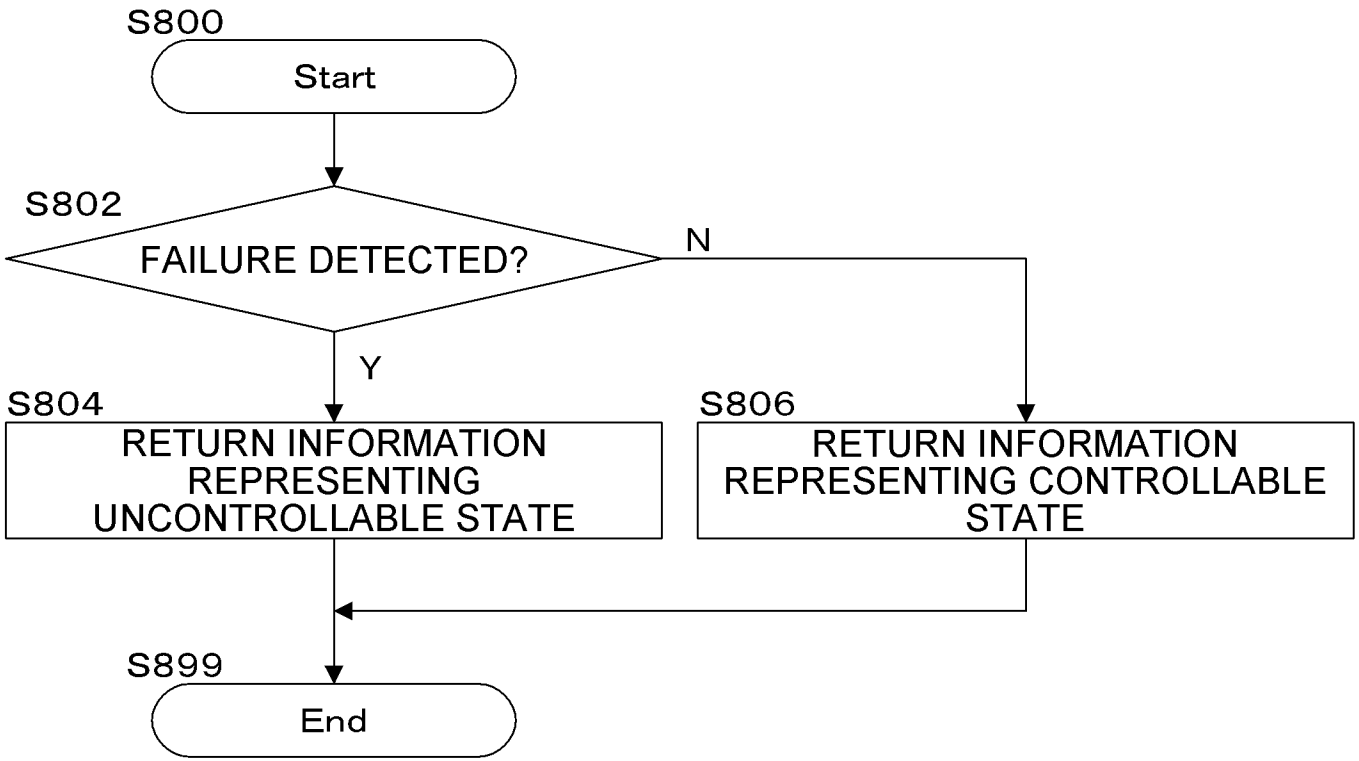
FIG. 8 is a flow chart illustrating an exemplary processing by an exemplary embodiment.

FIG. 8 is a flow chart illustrating an exemplary processing by the present exemplary embodiment. The flow chart is a specific example of the process of the step S602 in the flow chart illustrated in the example of FIG. 6 or the step S702 in the flowchart illustrated in the example of FIG. 7.

In a step S802, the detection module 115 determines whether the operating data transmitted from an automatic driving vehicle 140 include data representing a failure. When it is determined that the operating data include data representing a failure, the process proceeds to a step S804, and otherwise, the process proceeds to a step S806.

In the step S804, the detection module 115 returns information representing an uncontrollable state.

In the step S806, the detection module 115 returns information representing a controllable state.

Figure 9:
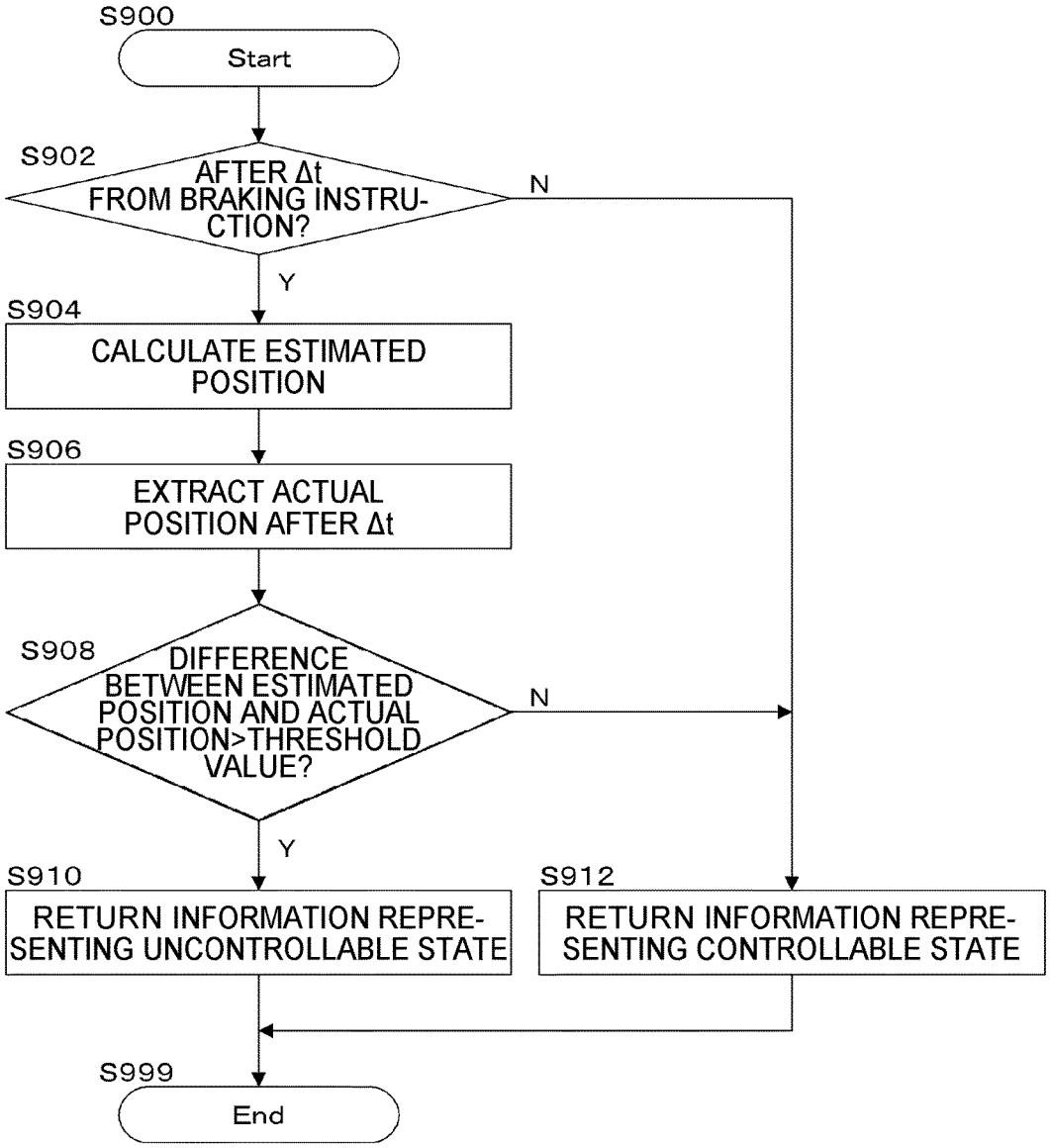
FIG. 9 is a flow chart illustrating an exemplary processing by an exemplary embodiment.

FIG. 9 is a flow chart illustrating an exemplary processing by the present exemplary embodiment.

In a step S902, the detection module 115 determines whether $\Delta t$ has lapsed after a braking instruction. When it is determined that $\Delta t$ has lapsed from a braking instruction, the process proceeds to a step S904, and otherwise, the process proceeds to a step S912.

In the step S904, when the braking has operated normally according to the braking instruction, the detection module 115 calculates an estimated position (target position) after $\Delta t$.

In a step S906, the detection module 115 extracts actual position data after Δt (data representing a position of the automatic driving vehicle 140 at a current time point).

In a step S908, the detection module 115 determines whether a "(difference between the estimated position and the actual position)>a threshold value." When it is determined that a "(difference between the estimated position and the actual position)>a threshold value" (that is, in a case where the braking is not operating normally, and for example, in a case where a slipping is occurring), the process proceeds to a step S910, and otherwise, the process proceeds to the step S912.

In the step S910, the detection module 115 returns information representing an uncontrollable state.

In the step S912, the detection module 115 returns information representing a controllable state.

Figure 10:
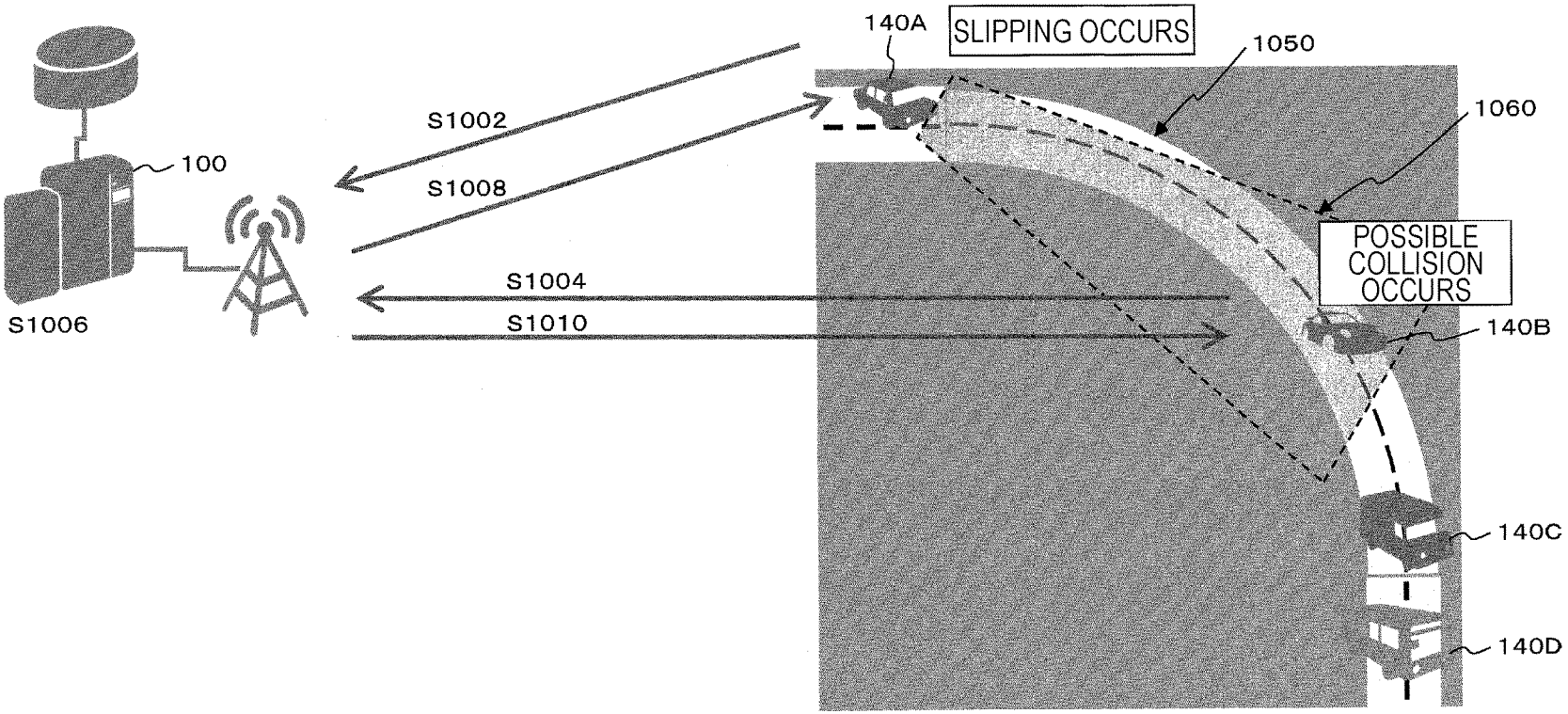
FIG. 10 is an exemplary view illustrating an exemplary processing by an exemplary embodiment.

FIG. 10 is a view for explaining an exemplary processing by the present exemplary embodiment.

An automatic driving vehicle 140A, an automatic driving vehicle 140B, an automatic driving vehicle 140C, and an automatic driving vehicle 140D are travelling on a road 1050. It is supposed that the automatic driving vehicle 140A is slipping (an example of the circumstance where the control of the automatic driving vehicle 140 is difficult).

In a step S1002, the information processing apparatus 100 receives position data and operating data (e.g., the interpretation target data table 500) from the automatic driving vehicle 140A.

In a step S1004, the information processing apparatus 100 receives position data and operating data (e.g., the interpretation target data table 500) from an automatic driving vehicle 140 (e.g., the automatic driving vehicle 140B) other than the automatic driving vehicle 140A.

In a step S1006, it is determined by the process of the flow chart illustrated in the example of FIG. 9 that the automatic driving vehicle 140A is under an uncontrollable state. Specifically, since the difference between the estimated position after the braking instruction and the current position is larger than a threshold value, it is detected that the slipping is occurring in the automatic driving vehicle 140A.

When the tires have grips, a distance required until the braking (e.g., stopping) is calculated by using a statistical process (e.g., an average value, a median, a mode, 6 times a sum of an average value and a standard deviation, and 6 times a sum of a median and a standard deviation) from the data stored in the range related data storage module 120.

A possible collision range (a possible collision range 1060 illustrated in the example of FIG. 10) is calculated from a traveling direction, a movement direction calculated from time-series position data, and the above-described distance.

Then, a vehicle existing within the range is extracted (here, the automatic driving vehicle 140B), and warning information representing the possible collision is transmitted to the vehicle (S1010).

Alternatively, the following processes may be performed.

Data for a vehicle operation to cause a vehicle (here, the automatic driving vehicle 140B) to move out of the possible collision range 1060 are generated. Then, the control data to cause the vehicle (here, the automatic driving vehicle 140B) to move out of the possible collision range 1060 are transmitted to the vehicle (S1010).

In a step S1008, the information processing apparatus 100 transmits, to the automatic driving vehicle 140A, control data such as date and time, information representing a slipping occurrence, warning information representing the existence of a vehicle (here, the automatic driving vehicle 140B) which may collide with the automatic driving vehicle 140A, a steering angle for avoiding the collision, an accelerator, and a brake. However, since the automatic driving vehicle 140A is slipping, the control may not be thoroughly implemented.

In the step S1010, the information processing apparatus 100 transmits, to the automatic driving vehicle 140B, control data such as date and time, information representing no slipping occurrence, warning information representing the existence of a vehicle (here, the automatic driving vehicle 140A) which may collide with the automatic driving vehicle 140B, a steering angle for avoiding the collision (moving out of the possible collision range 1060), an accelerator, and a brake.

Figure 11:
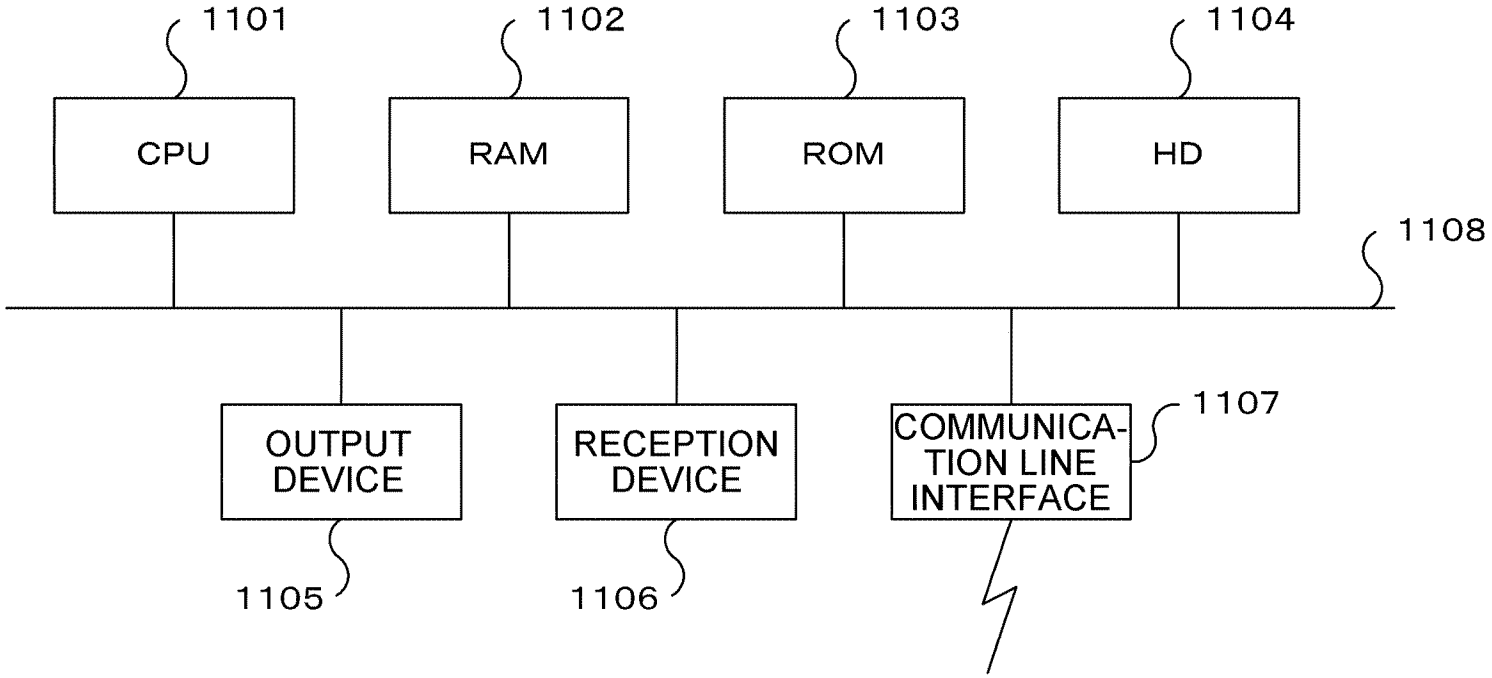
FIG. 11 is a block diagram for explaining an exemplary computer hardware configuration to implement an exemplary embodiment.

In addition, the hardware configuration of the computers in which the programs as the present exemplary embodiment are executed is general computers as illustrated in FIG. 11, and specifically, embedded computers (also called a control computer, e.g., an electronic/engine control unit (ECU)), computers serving as servers, or the like. That is, as a specific example, a CPU 1101 is used as a processor (arithmetic unit), a RAM 1102, a ROM 1103, and an HD 1104 are used as storage devices. As for HD 1104, for example, a hard disk or a solid state drive (SSD) may be used. The hardware configuration includes the CPU 1101 which executes programs such as the data transmission/reception module 105, the detection module 115, the range setting module 125, the object extraction module 130, the control data generation module 135, the control position extraction module 155, the comparison control module 160, the data collection module 170, the data transmission module 175, the data reception module 180, the collision warning module 185, and the vehicle operation module 195, the RAM 1102 which stores the programs or data, the ROM 1103 which stores a program or the like to start the computers, the HD 1104 which is an auxiliary storage device (that may be, for example, a flash memory) having the functions of the data storage module 110, the range related data storage module 120, the data storage module 165, and the data storage module 190, an reception device 1106 which receives data based on a user's operation of a touch screen, a microphone, a keyboard, a mouse or the like or data from the various sensors 145, the position detection module 150 and others, an output device 1105 which outputs control data to a liquid crystal display, a speaker, or each component within the vehicle 240, a communication line interface 1107 for connection to a communication network, such as a network interface card, and a bus 1108 which connects the above-described components to each other for exchange of data. These computers may be connected to each other by plural interconnection networks.

Among the above-described exemplary embodiments, the exemplary embodiments relating to computer programs are implemented by causing the computer programs as software to be read into the present hardware configuration system, and causing the software and the hardware resources to cooperate with each other. For example, the computer programs may be equipped on the operation system (OS) for an automobile control, or inside the automobile control OS.

In addition, the hardware configuration illustrated in FIG. 11 is an exemplary configuration. The exemplary embodiments of the present invention are not limited to the configuration illustrated in FIG. 11, and may have any configuration that enables the execution of the modules described in the exemplary embodiments of the present invention. For example, a portion of the modules may be configured as dedicated hardware (e.g., an application specific integrated circuit (ASIC) for a specific use), and a portion of the modules may be provided within an external system and connected to the other modules through a communication line. In addition, the systems illustrated in FIG. 11 may be connected to each other by plural interconnection communication lines to operate in cooperation with each other.

In addition, a vehicle 240 may include therein the information processing apparatus 100 and the automatic driving vehicle 140. In this case, the communication from the information processing apparatus 100 to another vehicle 240 is conducted between the vehicles 240. For example, the CACC may be used for the communication between the vehicles 240.

In addition, the above-described programs may be provided by being stored in a recording medium, or the programs may be provided by a communication unit. In this case, for example, the above-described programs may be construed as an invention of "computer readable recording medium storing a program."

The "computer readable recording medium storing a program" indicates a computer readable recording medium storing a program, which is useful for installation, execution, distribution and others of a program.

In addition, the recording medium is, for example, a digital versatile disc (DVD) such as "DVD-R, DVD-RW, and DVD-RAM" which are formats defined in the DVD forum, and "DVD+R and DVD+RW" which are formats defined for DVD+RW, a compact disc (CD) such as a CD read only memory (CD-ROM), a CD recordable (CD-R), and a CD rewritable (CD-RW), a Blu-ray (registered trademark) disc, a magneto-optical (MO) disc, a flexible disc (FD), a magnetic tape, a hard disc, a read-only memory (ROM), an electrically erasable and programmable read-only memory (EEPROM (registered trademark)), a flash memory, a random access memory (RAM), and a secure digital (SD) memory card.

In addition, all or some of the above-described programs may be saved or distributed by being recorded in the recording medium. The programs may be caused to be transmitted by a communication using a transmission medium such as a wired network, a wireless communication network, or a combination thereof used for a local area network (LAN), a metropolitan area network (MAN), a wide area network (WAN), the Internet, the Intranet, the Extranet and others. In addition, the programs may be carried by carrier waves.

Furthermore, the above-described programs may be some or the entirety of other programs, or may be recorded together with separate programs in a recording medium. In addition, the programs may be divided and recorded in plural recording media. In addition, the programs may be recorded in any form, such as compression or encryption, as long as the programs in that form may be restored.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An information processing apparatus, comprising:

a computer programmed to:

collect position data representing a position of a moving body and operating data representing an operating state of the moving body, during a movement of the moving body;

set a range in which the moving body is likely to cause a collision, based on a movement distance and direction required until a braking of the moving body, when a difference between a position of the moving body and a position at which the moving body is expected to be under a normal condition of the moving body is equal to or larger than a predetermined threshold value, or it is detected that a component for the movement of the moving body is failed;

extract a moving body existing within the range or a moving body which is likely to enter into the range;

generate control data to cause the extracted moving body to move out of the range; and transmit the control data and information representing a possibility of being collided, to the extracted moving body.

2. The information processing apparatus according to claim 1, further comprising:

a sensor that detects environment data including at least one of an outside temperature, an outside humidity, a front-rear inclination angle and a left-right inclination angle, wherein the range is set by using the environment data detected by the sensor.

3. The information processing apparatus according to claim 1, wherein the control data is regarding a component for the movement.

4. The information processing apparatus according to claim 3, wherein the component for the movement is represents at least one of a steering angle, an accelerator and a brake.

5. A non-transitory computer readable recording medium storing a collision avoidance program causing a computer to:

acquire first position data and operating data of a first moving body, and second position data of a second moving body;

specify a range in which the first moving body is likely to cause a collision, based on the first position data and the operating data; and determine whether the second moving body exists in the range, based on the second position data, generate a control instruction, and transmit the control instruction and information representing a possibility of being collided to the second moving body to cause the second moving body to move out of the range when it is determined that the second moving body exists in the range.

6. The non-transitory computer readable recording medium according to claim 5, wherein the program further causes the computer to:

store braking data, and calculate a reference movement distance required until a braking is implemented under a condition identical to a braking condition included in the braking data, and wherein the range is specified by using the calculated reference movement distance.

7. The non-transitory computer readable recording medium according to claim 6, wherein the braking data are prepared based on the operating data.

8. A non-transitory computer readable recording medium storing an information processing program causing a computer to:

collect position data representing a position of a moving body and operating data representing an operating state of the moving body, during a movement of the moving body;

set a range in which the moving body is likely to cause a collision, based on a movement distance and direction required until a braking of the moving body, when a difference between a position of the moving body and a position at which the moving body is expected to be under a normal condition of the moving body is equal to or larger than a predetermined threshold value, or it is detected that a component for the movement of the moving body is failed;

extract a moving body existing within the range or a moving body which is likely to enter into the range;

generate control data to cause the extracted moving body to move out of the range; and transmit the control data and information representing possibility of being collided, to the extracted moving body.

* * * * *